US006879305B2

(12) United States Patent
Takeuchi et al.

(10) Patent No.: US 6,879,305 B2
(45) Date of Patent: Apr. 12, 2005

(54) PLASMA DISPLAY APPARATUS WITH INCREASED PEAK LUMINANCE

(75) Inventors: Masanori Takeuchi, Kawasaki (JP); Kyoji Kariya, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 259 days.

(21) Appl. No.: 10/079,904

(22) Filed: Feb. 22, 2002

(65) Prior Publication Data

US 2003/0025653 A1 Feb. 6, 2003

(30) Foreign Application Priority Data

Aug. 2, 2001 (JP) ..... 2001-235019

(51) Int. Cl.[7] ..... G09G 3/28
(52) U.S. Cl. ..... 345/63; 345/60; 315/169.4
(58) Field of Search ..... 345/60, 63, 67, 345/205, 208, 210; 313/581, 582; 315/169.4

(56) References Cited

U.S. PATENT DOCUMENTS 6,407,506 B1 6/2002 Naka et al.
6,465,970 B2 * 10/2002 Nagakubo et al. ..... 315/169.4
6,590,571 B2 * 7/2003 Laffargue et al. ..... 345/204
2002/0021263 A1 * 2/2002 Honda et al. ..... 345/55
2002/0027535 A1 * 3/2002 Van Dijk ..... 345/60

FOREIGN PATENT DOCUMENTS

EP 0 762 373 A2 3/1997
JP 2000-347616 12/2000

* cited by examiner

*Primary Examiner*—Kent Chang
*Assistant Examiner*—Tom Sheng
(74) *Attorney, Agent, or Firm*—Staas & Halsey LLP

(57) ABSTRACT

A PDP apparatus, the peak luminance of which has been improved with little modification of the existing circuit structure, has been disclosed, in which a thinning process that shortens an address period by hiding part of display lines in a fixed subfield of a low luminance is performed, the saved time is increased by an amount corresponding to that from which the luminance weight (the number of sustain discharge pulses, that is, the length of the sustain discharge period) of the thinned subfield of a low luminance is subtracted, and the remaining time is allocated at the ratio of the luminance weights on completion of the first step in each subfield.

25 Claims, 18 Drawing Sheets

FIRST FIELD

SECOND FIELD

PLASMA DISPLAY APPARATUS WITH INCREASED PEAK LUMINANCE

BACKGROUND OF THE INVENTION

The present invention relates to a plasma display apparatus and a driving method thereof. More particularly, the present invention relates to a plasma display apparatus, the display luminance of which has been improved with a simple modification of the circuit, and a driving method thereof.

The plasma display apparatus (PDP apparatus) has been put to practical use as a flat display and is highly regarded as a thin high-luminance display. Among several types of the PDP apparatus, a three-electrode surface discharge AC type PDP apparatus is most generally used and is used as an example in the description below.

FIG. 1 is a block diagram that shows the rough structure of a conventional PDP apparatus. A video signal enters a display gray level adjustment circuit 4, is adjusted to a level appropriate to the gray level display, and is developed into the data of a subfield structure, which will be described later, in a video signal—subfield matching circuit 5. The video signal is also entered into an average luminance detection circuit 7 and the average luminance is detected. A subfield unit pulse number setting circuit 8 determines the number of sustain discharge pulses of each subfield based on the length of the period of a field calculated from the synchronization signal and the detected average luminance. This is performed because there is a limit to the power consumption in the PDP apparatus and the total number of sustain discharge pulses is decreased to prevent the power consumption from exceeding the limit value when the average luminance is high. A subfield process circuit 6 generates a switch timing signal for each operation period, which will be described later, according to the number of sustain discharge pulses of each subfield determined by the subfield unit pulse number setting circuit 8, and sends it to a drive waveform generation circuit 9. The drive waveform generation circuit 9 generates a voltage waveform to be applied to the sustain discharge electrode according to the above-mentioned switch timing signal and sends it to a sustain electrode drive circuit 2. Simultaneously, the subfield process circuit 6 reads the display data of each subfield from the video signal—subfield matching circuit 5 and sends it to a data drive circuit 3. The sustain electrode drive circuit 2 applies a voltage, of a waveform which will be described later, to the sustain discharge electrodes (X electrode and Y electrode) of a three-electrode surface discharge AC type plasma display panel 1, and the data drive circuit 3 synchronously applies a data voltage to the address electrode. In the three-electrode surface discharge AC type plasma display panel 1, X electrodes and Y electrodes that extend in one direction are arranged adjacently by turns, address electrodes that extend in the direction perpendicular thereto are arranged, and display pixels are formed at the crossings of a pair of the X electrode and the Y electrode and each address electrode. The X electrode and the Y electrode constitute a sustain discharge electrode, the X electrode is commonly connected, and receives an identical voltage waveform, and a sustain discharge pulse is commonly applied to the Y electrode, as well as a scan pulse is independently applied thereto. Moreover, the address electrode is designed so that an address pulse can be independently applied thereto.

FIG. 2 is a diagram that shows the drive waveforms of the PDP apparatus. The drive sequence of the PDP apparatus comprises a reset period in which all the display cells are set to a uniform state, an address period in which the display cell is set to a state corresponding to the display data, and a sustain discharge period in which the display cell is made to emit light according to the set state. As shown schematically, in the reset period, while the Y address electrode is being kept at 0V, a pulse of voltage Vaw is applied to the address electrode and a pulse of voltage Vw, to the X electrode. In this way, a reset discharge is caused to occur in all the display cells regardless of the previous display state, the generated charges are neutralized, and all the display cells enter a uniform state. In the address period, while voltage Vx is being applied to the X electrode, a scan pulse is sequentially applied with voltage—Vc being applied to the Y electrode. The scan pulse is overlapped by the voltage—Vc and becomes a pulse of voltage—Vy. In synchronization with the application of each scan pulse, a data voltage is applied to the address electrode. The data voltage is Va in a lit display cell and 0V in an unlit display cell. In this way, an address discharge is caused to occur in a lit display cell and different charges are accumulated on the X electrode and the Y electrode, and no charge is accumulated in an unlit display cell because no discharge is caused to occur. By performing this action to every Y electrode, all the display cells enter a state that corresponds to the display data. In the sustain discharge period, while voltage Ve is being applied to the address electrode, the sustain discharge pulse of voltage Vs is applied alternately to the Y electrode and the X electrode. When the first sustain discharge pulse is applied to the Y electrode, a sustain discharge is caused to occur in a lit display cell because the voltage due to the charges accumulated during the address period is added to the sustain discharge pulse, and this sustain discharge causes charges, which have the opposite polarity to the previous ones, to accumulate on the X electrode and the Y electrode, therefore, if another sustain discharge pulse is applied to the X electrode, a sustain discharge is caused to occur again. Repetition of these actions causes a sustain discharge to occur successively. On the other hand, since no charge is accumulated in an unlit display cell, no discharge is caused to occur even if a sustain discharge pulse is applied. This sustain discharge relates to the display and the luminance of the subfield is determined by the number of times of sustain discharges, that is, the length of the sustain discharge period.

As described above, it is possible only to control a display cell to emit light or not in the PDP apparatus and the intensity of light emission cannot be altered for each cell. Therefore, when the gray level display is performed, a display field is composed of plural subfields. FIG. 3 is a diagram that illustrates the subfield structure for gray level display. As shown schematically, one display field is composed of plural subfields (four in this case) SF1–SF4. Each subfield comprises a reset period R, an address period A, and a sustain discharge period S, and the length of the sustain discharge period S, that is, the luminance, is different. For example, the luminance ratio of SF1–SF4 is 8:4:2:1. A desired luminance of light emission can be obtained for each display cell by selecting the subfields that emit light in a display field. This example of the subfield structure can provide 16 levels, that is, 0 to 15. For a display cell of level 7, SF2, SF3, and SF4 are lit, and for a display cell of level 12, SF1 and SF2 are lit.

The conventional PDP apparatus is described above and various methods have been proposed, but a more detailed description will not be provided here because the detailed structures thereof are publicly known.

One of the characteristics of PDP apparatus inferior to the CRT tube TV is that the peak luminance is low. One of the reasons is that the proportion of the sustain discharge period that relates to the display luminance in a display field is small. As shown in FIG. 3, one display field is composed of plural subfields and each subfield has the reset period and the address period of the same length regardless of the length of the sustain discharge period. In the actual PDP apparatus, one display field has eight to ten subfields in order to attain a sufficient gray level display and suppress problems such as color false contour. Therefore the reset period and the address period, which do not relate to the display luminance, occupy a large proportion of a display field and a problem that a sufficient peak luminance cannot be obtained is caused because the sustain discharge period cannot be sufficiently lengthened.

In order to solve these problems, Japanese Unexamined Patent Publication (Kokai) No. 2000-347616 has disclosed a technique to realize an improvement in the comprehensive image qualities, such as the gray level, by controlling the information on the resolution of the displayed image. In the technique, the address process is performed simultaneously for n (n is an integer equal to two or larger) lines in a special subfield to shorten the address period to 1/n, and the luminance is improved by allocating the saved time to the sustain discharge period of each subfield. The above-mentioned publicly known document has also disclosed compensation of the lighting information data to retain the image information as long as possible for the n lines, to which the address process is performed simultaneously, by performing calculation between each of n display cells in the vertical direction.

In order to realize the technique disclosed in Japanese Unexamined Patent Publication (Kokai) No. 2000-347616, however, it is necessary to modify the circuit so that the address process can be performed simultaneously for n display lines, therefore, a problem that such modification will be complex is caused.

SUMMARY OF THE INVENTION

The object of the present invention is to improve the peak luminance without major modification to the circuit structure of the conventional PDP apparatus.

In order to realize the above-mentioned object, some of the display lines in the specified subfield, with a low luminance, are not displayed in the plasma display apparatus (PDP apparatus) of the present invention. This process is called the thinning process hereinafter. This process can shorten the address period and the saved time is allocated to the sustain discharge period in the following two steps.

Fist, since the luminance of the fixed display area in the subfield with a low luminance, to which the thinning process has been performed, is lowered to about 1/n, the saved time is allocated in the first step so that the luminance weight (the number of sustain discharge pulses, that is, the length of the sustain discharge period) of this subfield becomes about n times that before the thinning process. As a result, the gray level continuity in the fixed display area can be maintained.

In the second step, the rest of the saved time is allocated to each subfield with the ratio of the luminance weight at the completion of the first step. As a result the luminance is improved.

As described above, power consumption is controlled in the PDP apparatus and when the average luminance is high, the total number of sustain discharge pulses is decreased so that the power consumption does not exceed the limit value. As the consumption power increases when the thinning process of the present invention is performed because the luminance increases, it is designed so that the thinning process is performed when the average luminance is below a specified value.

Although the thinning process is performed in a subfield with a low luminance, the number of the subfields in which the thinning process is performed can be one or plural.

In the thinning process, one of the plural display lines that are adjacent to each other is displayed and the other display lines are thinned out so that they are not displayed. In the PDP apparatus that performs the interlaced display, however, one of the display lines that are adjacent to each other is displayed and the others are thinned out in an odd-numbered field and an even-numbered field, respectively. Therefore, in the case of the interlaced display, two lines in the adjacent odd-numbered field and the even-numbered field, respectively, are displayed and the other lines are thinned out.

In such a thinning method, however, a state in which a certain part of image information is lost continues, as a result, and the quality of image may be affected. It is advisable, therefore, to successively change the display line to be displayed among plural adjacent display lines.

Moreover, when the thinning process of the present invention is applied, it is possible that the surface temperature of the plasma display panel increases locally and the panel is damaged, therefore, it is designed so that the temperature of the panel is detected and the thinning process is not performed when the temperature is higher than a specified degree.

BRIEF DESCRIPTION OF THE DRAWING

The features and advantages of the invention will be more clearly understood from the following description taken in conjunction with the accompanying drawings, in which.

DESCRIPTION OF THE PREFERRED EMBODIMENTS

Figure 1:
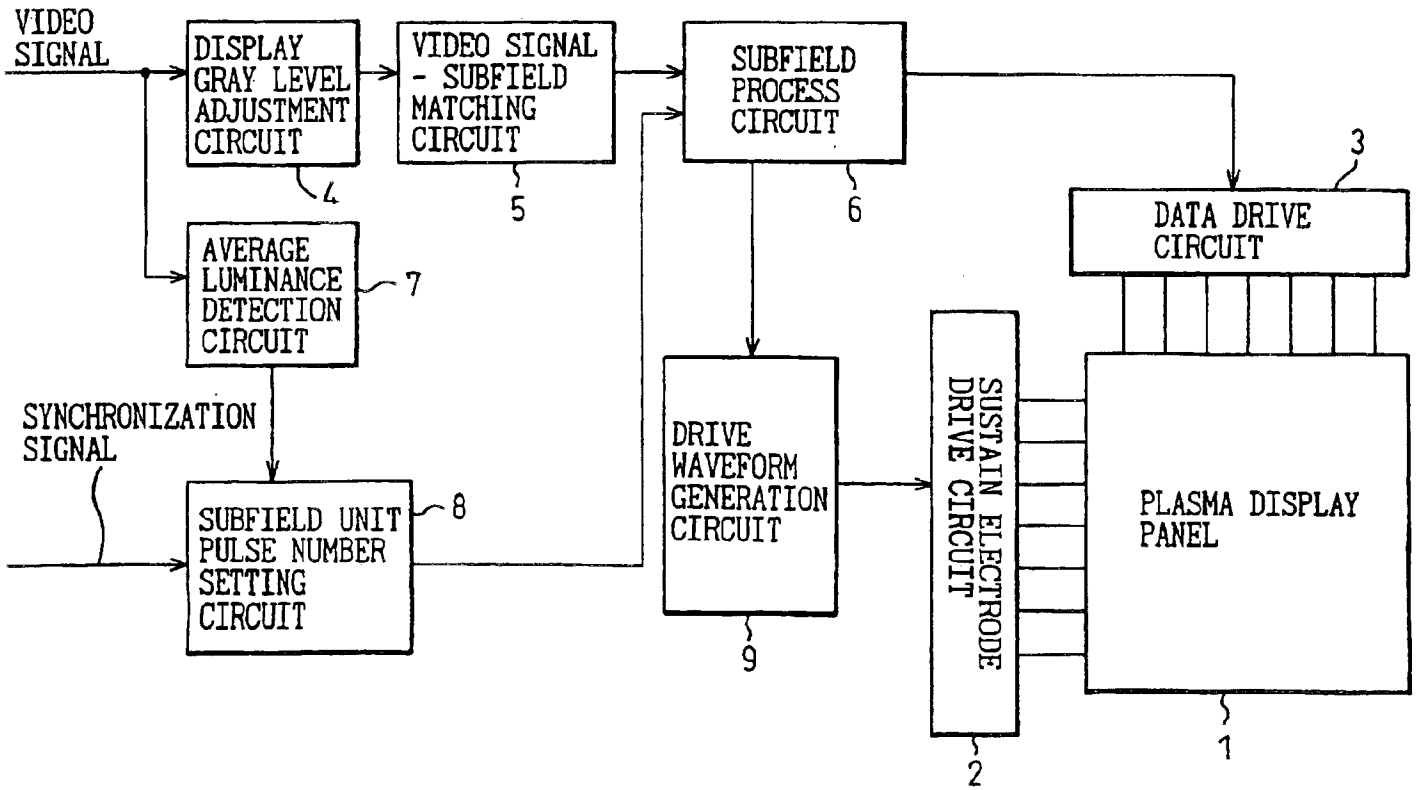
PRIOR ART Fig.1
FIG. 1 is a block diagram that shows the rough structure of a conventional plasma display apparatus (PDP apparatus).
Figure 4:
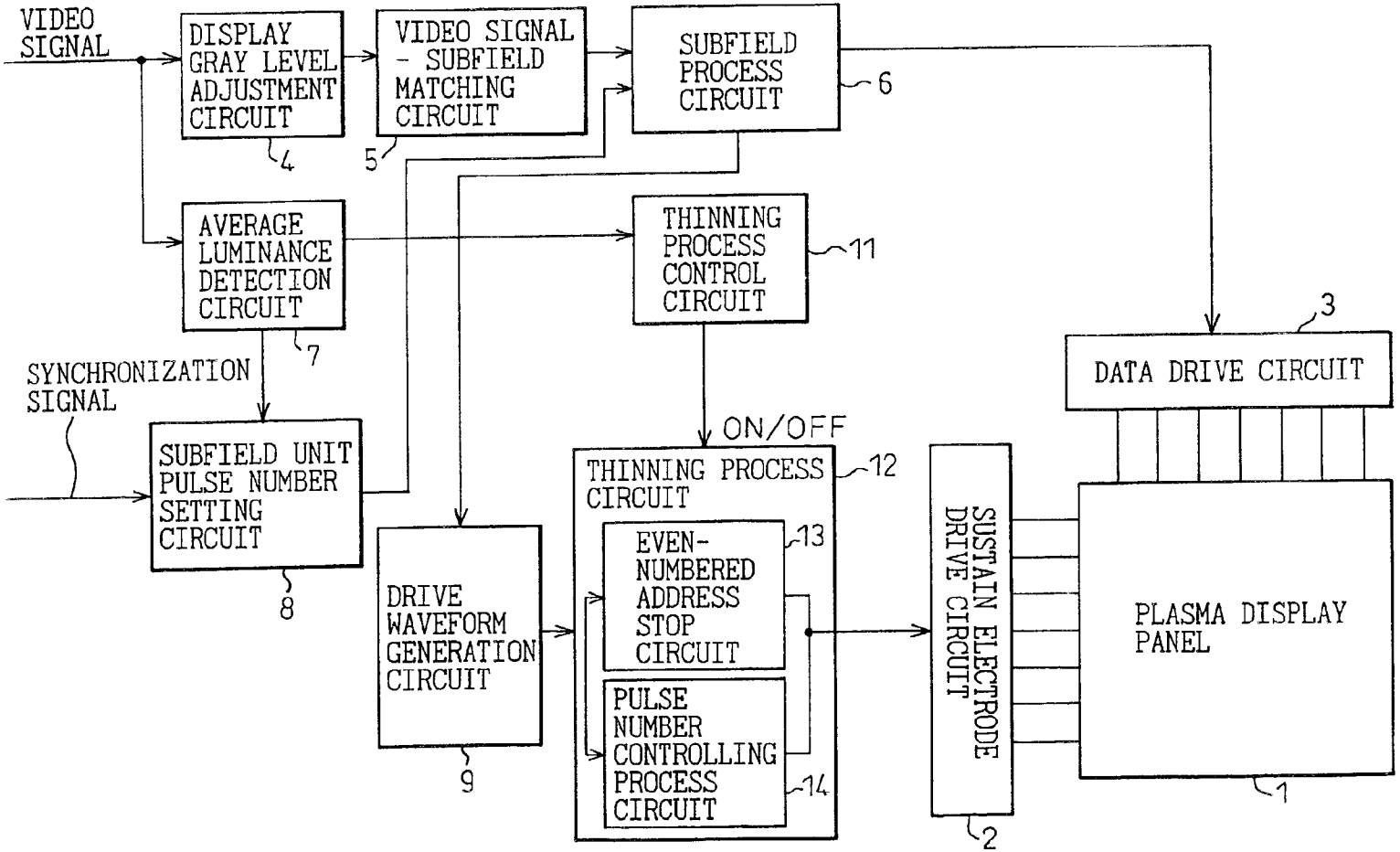
FIG. 4 is a block diagram that shows the rough structure of the PDP apparatus in the first embodiment of the present invention.

FIG. 4 is a block diagram that shows the rough structure of the PDP apparatus in the first embodiment of the present invention. It is obvious by a comparison with FIG. 1 that the PDP apparatus in the first embodiment differs in that a thinning process control circuit 11 and a thinning process circuit 12 are added to the conventional structure in FIG. 1 and other parts are the same, therefore, only the different parts are described below.

The average luminance detection circuit 7 detects the average luminance of the video signal to be entered and sends a detection signal to the thinning process control circuit 11 when the average luminance is below a specified value (20%, for example).

On receiving the detection signal from the average luminance detection circuit 7, the thinning process control circuit 11 turns the thinning process circuit 12 on, and specifies a special subfield as an object of the process. In this case, the number of the subfields may be one or more.

Figure 2:
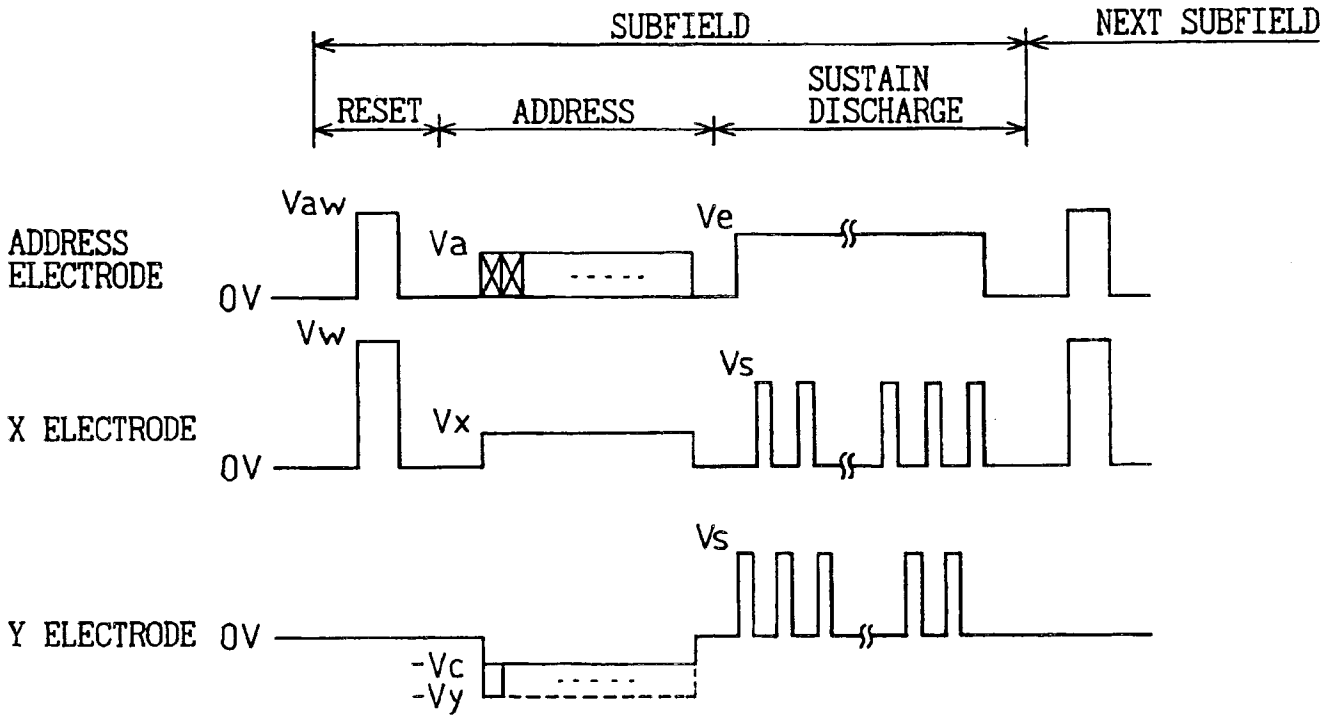
PRIOR ART Fig. 2
FIG. 2 is a diagram that shows the drive waveforms of the PDP apparatus.

When the thinning process circuit 12 is off, the drive waveforms of the sustain electrode generated in the drive waveform generation circuit 9 are applied to the sustain electrodes (X electrode and Y electrode) of the PDP 1 via the sustain electrode drive circuit 2. Therefore, the same waveforms as those in the conventional example shown in FIG. 2 are applied and the same display as the conventional one is attained. When the thinning process circuit 12 is on, an even-numbered address stop circuit 13 modifies the waveforms to those shown in FIG. 5 for the subfields that are the objects of the process. The waveforms shown in FIG. 2 are applied to the subfields other than the objects of the process. The waveforms shown in FIG. 5 perform the same address process as the conventional one for the odd-numbered electrodes but skip the even-numbered electrodes without an address process. In other words, the scan pulse is successively applied only to the odd-numbered electrodes at the same cycle as the conventional one and the address process is performed only to the odd-numbered display lines. Therefore, the address period becomes half that of the conventional one. Subsequently, the sustain discharge is caused to occur as conventionally by applying the sustain discharge pulse alternately to the X electrodes and the Y electrodes in the sustain discharge period, resulting in the light emission in the lit cell. Although the sustain discharge pulse is applied to both odd-numbered Y electrodes and even-numbered Y electrodes, it is acceptable that the sustain discharge pulse is not applied to the even-numbered Y electrodes. In this case, however, it is necessary to modify the drive circuit so that the sustain discharge pulse can be applied independently to the odd-numbered Y electrodes and the even-numbered Y electrodes.

Figure 6:
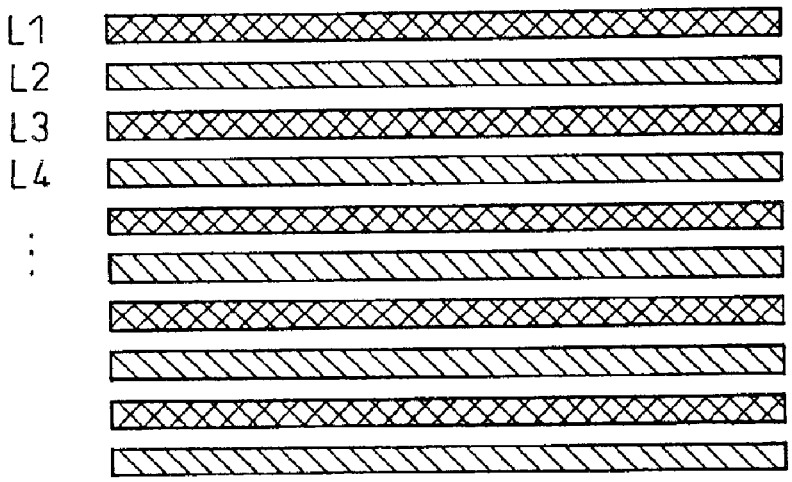
FIG. 6 is a diagram that shows the display lines in the first embodiment.

FIG. 6 illustrates the display lines when the thinning process is performed. As shown schematically, light is emitted in every subfield in the odd-numbered display lines L1, L3, . . . , shown by the crossed slant lines, but light is emitted only in upper subfields but not emitted in lower subfields in the even-numbered display lines L2, L4, . . . , shown by the one-directional slant lines.

By performing the above-mentioned thinning process, the address period is halved in the subfields that are objects of the thinning process. By allocating the saved time to the sustain discharge period, the luminance can be improved. If, however, the saved time is simply allocated according to the luminance weight of each subfield, the continuity in gray levels may be interrupted. Therefore, it is necessary to take into account the luminance compensation when allocating time. A pulse number controlling process circuit 14 in FIG. 4 allocates the time to the sustain discharge period, with the luminance compensation being taken into account.

Figure 7A:
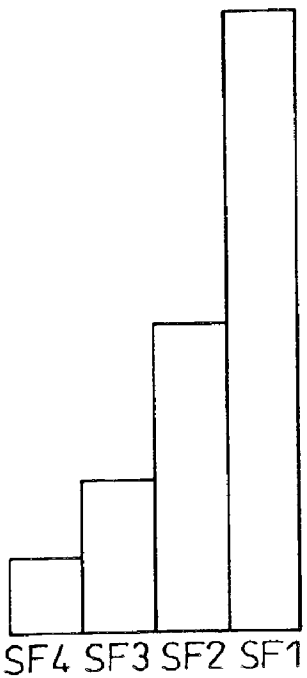
FIGS. 7A through 7D are diagrams that illustrate the principle of luminance compensation in the first embodiment.

FIG. 7A through FIG. 7D illustrate the principle of the allocation of the saved time, and show the concept of the luminance in each subfield in the fixed display area. FIG. 7A shows the luminance in each subfield before the thinning process. The figure shows the case in which the luminance ratio of the subfields SF1–SF4 is 8:4:2:1.

Figure 7B:
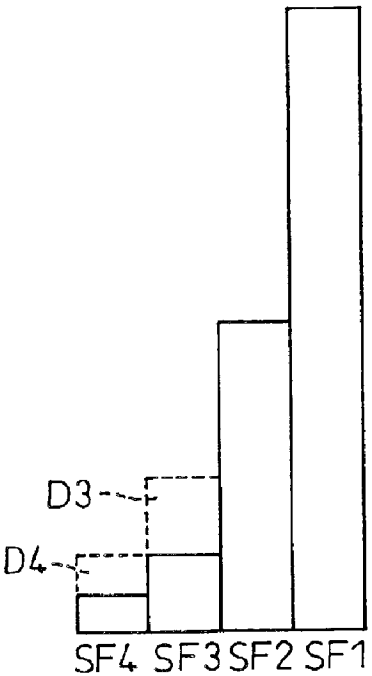

FIG. 7B shows the luminance after the thinning process has been performed to the subfields SF3 and SF4 as the objects of the process. In the subfields SF3 and SF4 to which the thinning process has been performed, the number of the display lines is halved, therefore, the luminance is almost halved and the parts shown by D3 and D4 are removed. As a result, the luminance ratio of the subfields SF1–SF4 becomes 8:4:1:1/2.

If the time saved in the address periods of SF3 and SF4 is allocated according to the weight in each subfield, the continuity of the gray level cannot be maintained. By performing the allocation of the saved time in the two steps as shown in FIG. 7C and FIG. 7D, the continuity in the gray level can be maintained.

Figure 7C:
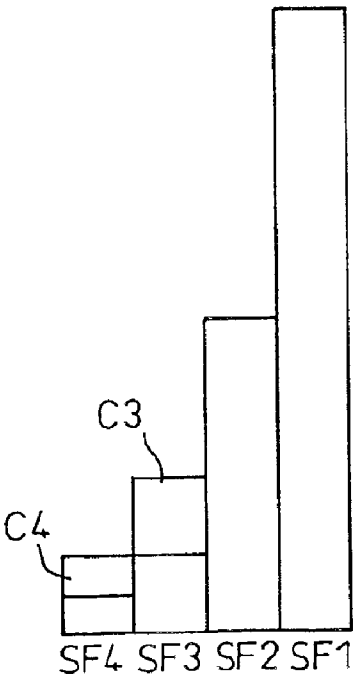

In the first step as shown in FIG. 7C, the number of the sustain discharge pulses (the sustain discharge period) of the thinned subfield is doubled and the luminance of SF3 and SF4 is increased by the amounts shown by C3 and C4, respectively, to maintain the continuity in the gray level.

Figure 7D:
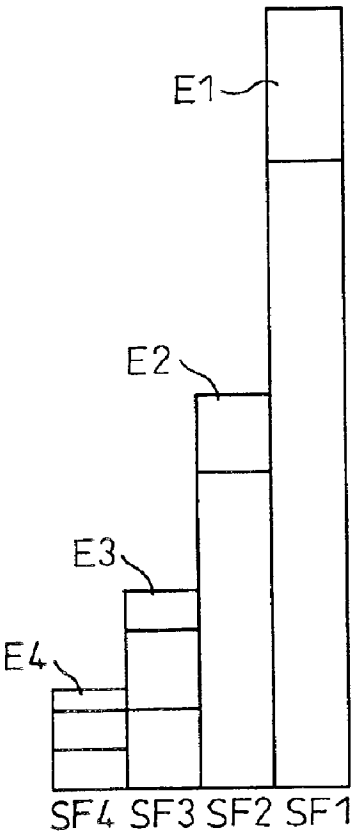

Then, in the second step, as shown in FIG. 7D, the rest of the saved time is allocated according to the ratio of the luminance weight of each subfield. In this way, the luminance of SF1–SF4 increases by the amounts shown by E1–E4, respectively.

The drive waveforms for the sustain electrodes compensated for in the thinning process circuit 12 are supplied to the sustain electrode drive circuit 2. During the thinning process, the display data of odd-numbered rows are sequentially read from the video signal subfield matching circuit 5 and supplied to data drive circuit 3 via the subfield process circuit 6.

Figure 3:
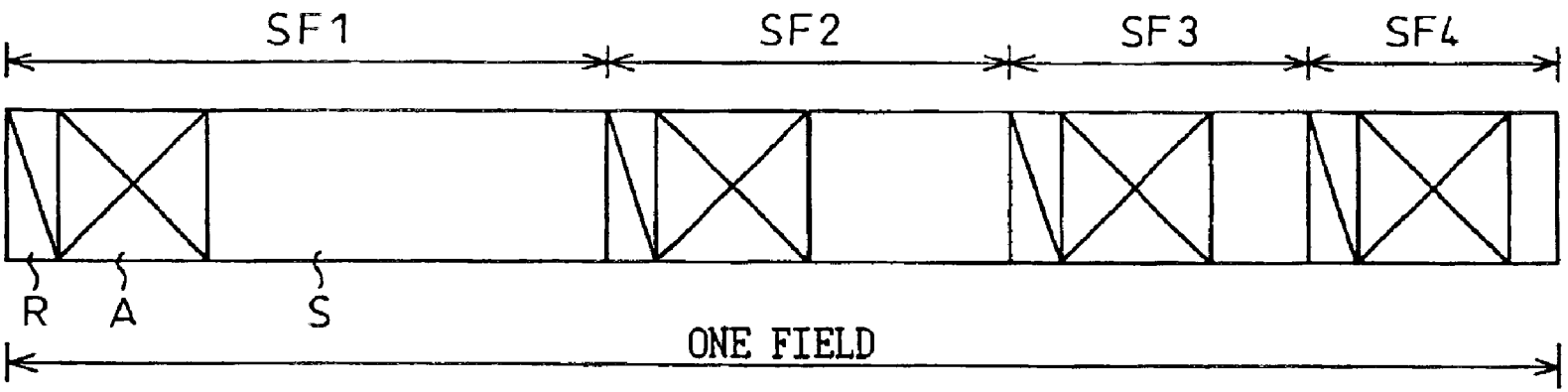
PRIOR ART Fig.3
FIG. 3 is a diagram that shows the structure of a subfield for the gray level display in the PDP apparatus.
Figure 8A:
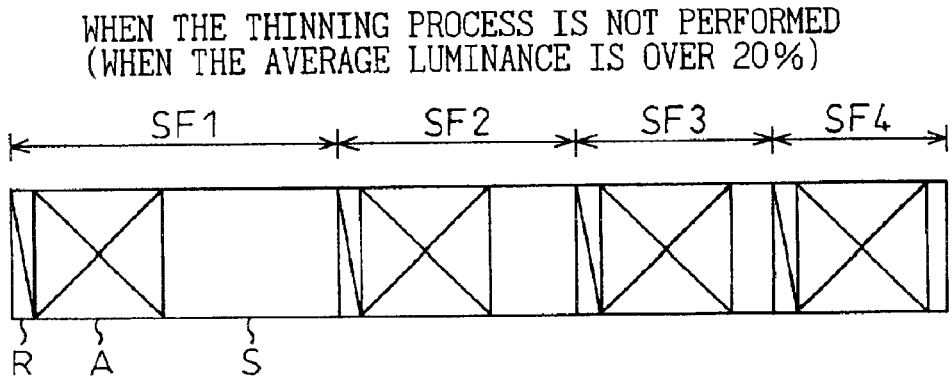
FIG. 8A and FIG. 8B are diagrams that show the subfield structures in the first embodiment.
Figure 8B:
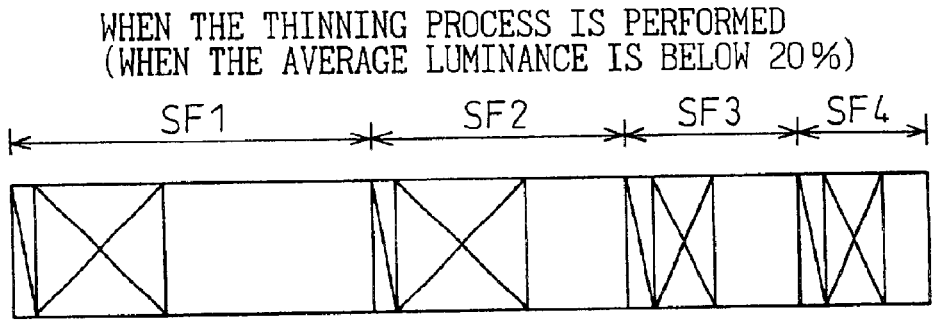

FIG. 8A and FIG. 8B are diagrams that show the subfield structure in the first embodiment. As shown in FIG. 8A, since the thinning process is not performed when the average luminance is over 20%, the display is attained in the subfield structure the same as the conventional one shown in FIG. 3. In other words, the address period A of subfields SF1–SF4 has the same length. On the contrary, the thinning process is performed when the average luminance is below 20% as shown in FIG. 8B, and the address periods of SF1 and SF2 are the same as those shown in FIG. 8A, but the address periods of SF3 and SF4 become half those of FIG.

8A. The sustain discharge periods S of SF3 and SF4 are more than double those of FIG. 8A, and the sustain discharge periods of SF1 and SF2 also increase.

In the first embodiment, even-numbered lines are not displayed and only odd-numbered lines are displayed in the subfield that is the object of the thinning process. In other words, the thinning process is performed in the range of two display lines, but it is possible to perform in the range of three or more rows.

Moreover, in the first embodiment, the display data of the even-numbered lines in the subfield that is the object of the thinning process is always lost, therefore, the quality of image may be degraded depending on the contents of the image. In the second embodiment, the position of the display line to be thinned is varied to prevent the degradation.

Figure 9:
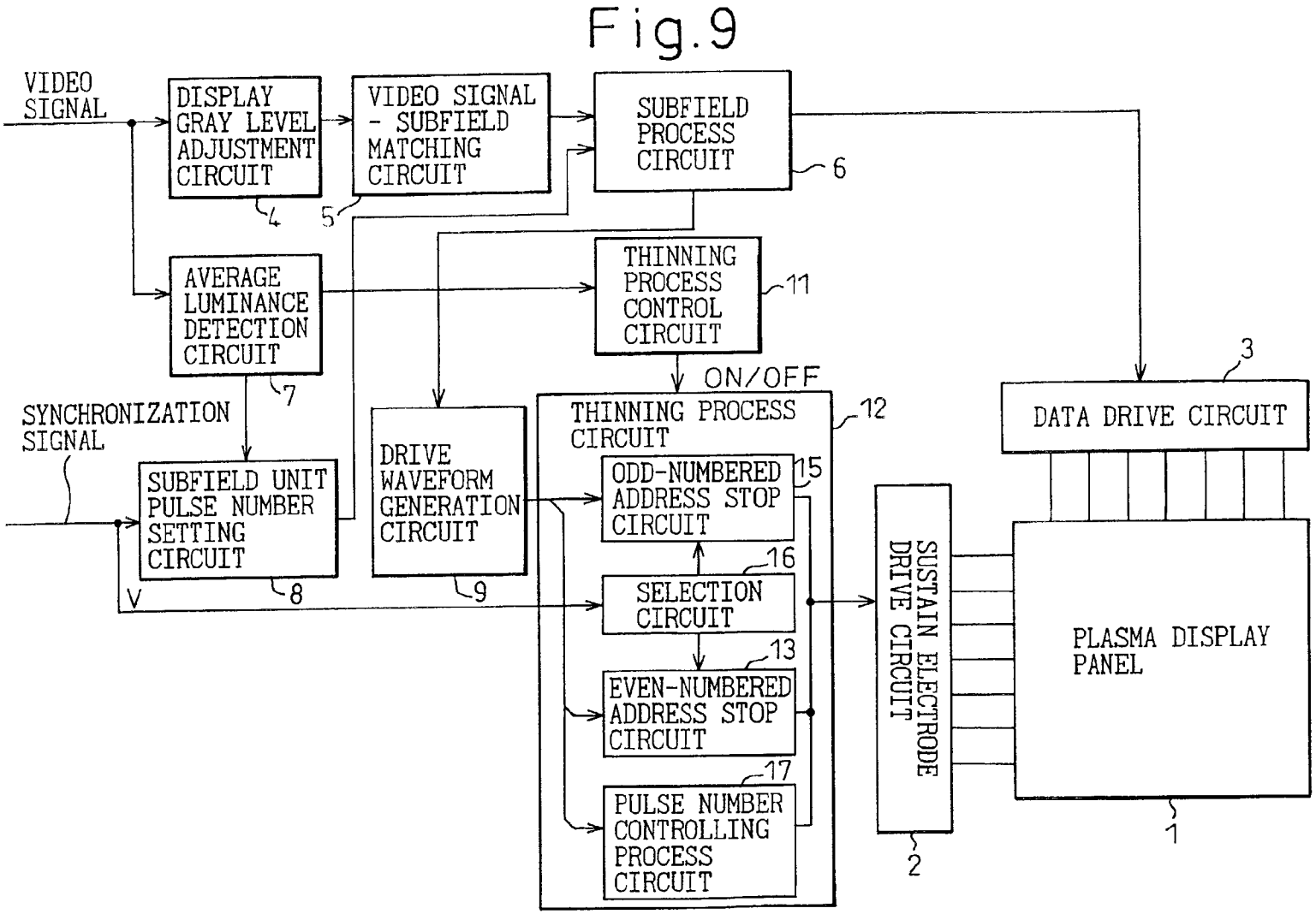
FIG. 9 is a block diagram that shows the rough structure of the PDP apparatus in the second embodiment of the present invention.

FIG. 9 is a block diagram that shows the rough structure of the PDP apparatus in the second embodiment of the present invention. It is obvious by a comparison with the FIG. 4 that the difference between the PDP apparatus in the second embodiment and that in the first embodiment exists in the structure of the thinning process circuit 12 and the other parts are the same, therefore, only the different parts are described below.

Figure 5:
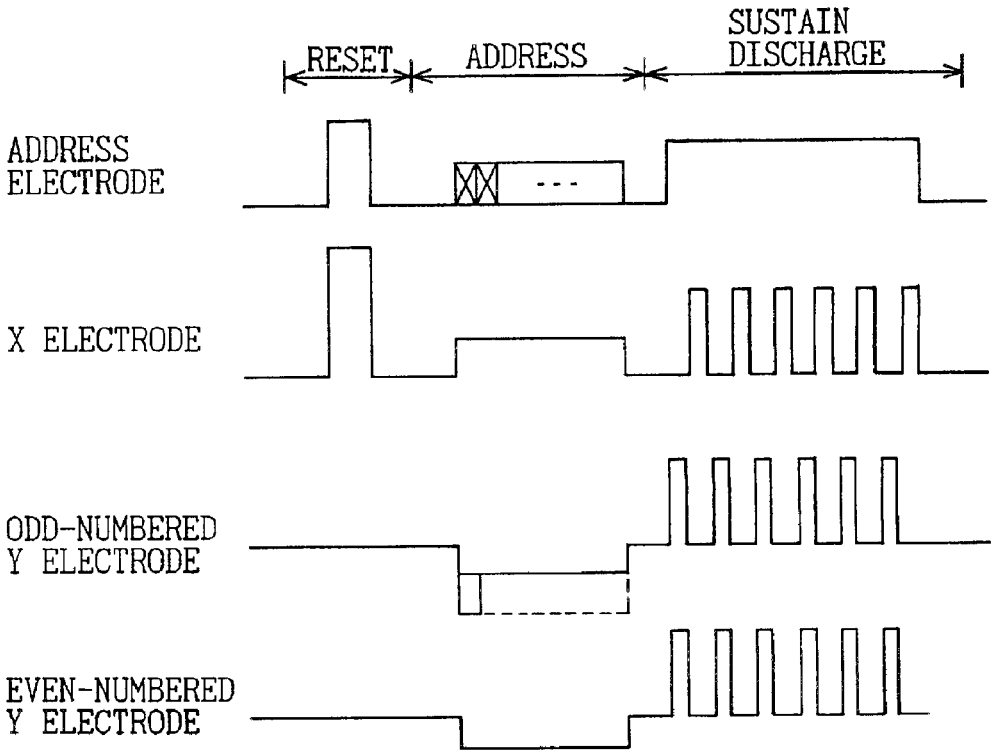
FIG. 5 is a diagram that shows the drive waveforms of the subfield for the thinning process in the first embodiment.

The thinning process circuit 12 in the second embodiment comprises an odd-numbered address stop circuit 15, in addition to the even-numbered address stop circuit 13, and turns either one into the active state according to the vertical synchronization signal V by a selection circuit 16. For example, when the average luminance is below 20%, the thinning process circuit 12 turns off the odd-numbered address stop circuit 15 in a certain field, turns on the even-numbered address stop circuit 13, and performs the thinning process as in the first embodiment. In the next field, the thinning process circuit 12 turns on the odd-numbered address stop circuit 15, turns off the even-numbered address stop circuit 13, and performs the thinning process for the subfield that is the object of the thinning process so that odd-numbered lines are not displayed but only the even-numbered lines are displayed. The thinning process in this case is that in which the odd-numbered lines and the even-numbered lines are interchanged in the first embodiment, and the waveforms shown in FIG. 5 are applied after those of the odd-numbered Y electrode and the even-numbered Y electrode are interchanged.

Figure 10A:
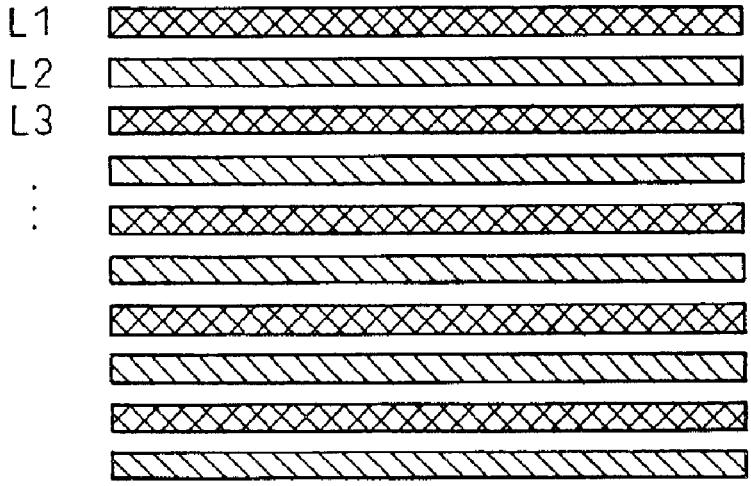
FIG. 10A and FIG. 10B are diagrams that show the display lines in the second embodiment.
Figure 10B:
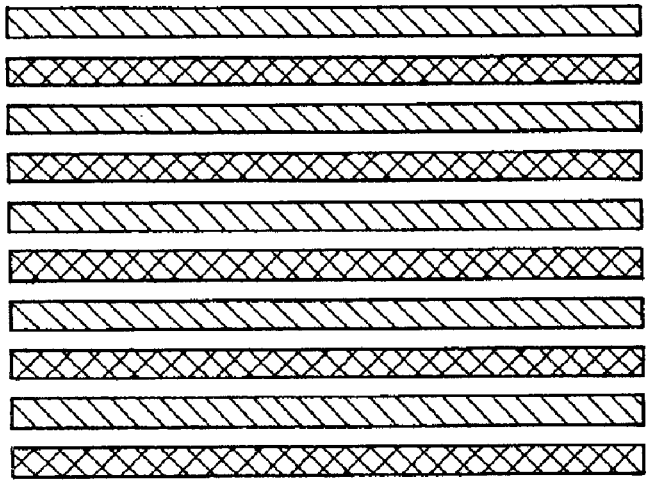

FIG. 10A and FIG. 10B are diagrams that show the display lines in the second embodiment, and the FIG. 10A shows the display lines in the first field, FIG. 10B shows those in the second field that follows the first field, and when the average luminance is below 20%, the first field and the second field are repeated alternately. As shown schematically, light is emitted in every subfield in the odd-numbered display lines L1, L3, . . . , shown by the crossed slant lines in the first field, but in the even-numbered display lines L2, L4, . . . , shown by the one-directional slant lines, light is emitted only in upper subfields, but not in lower subfields. In the second subfield, light is emitted in every subfield in the even-numbered display lines L2, L4, . . . , shown by the crossed slant lines, but in the odd-numbered display lines L1, L3, . . . , shown by the one-directional slant lines, light is emitted only in upper subfields, but not in lower subfields. As the first field and the second field are repeated alternately, a display almost faithful to the original image data can be obtained by totally combining the first field and the second field.

The first and second embodiments are those for the apparatus in which all the display lines are displayed at the same time, but the display method called the interlaced method, in which the odd-numbered display lines and the even-numbered display lines are displayed alternately, is employed in a device such as a TV receiver. Japanese Unexamined Patent Publication (Kokai) No. 9-160525 has disclosed the PDP apparatus employing the interlaced method called the ALIS method, in which the number of the display lines is doubled with the same number of sustain discharge electrodes as the conventional one. The embodiment in which the present invention has been applied to the PDP apparatus employing the interlaced method is described here, with the example of the PDP apparatus employing the ALIS method disclosed in Japanese Unexamined Patent Publication (Kokai) No. 9-160525.

Figure 11:
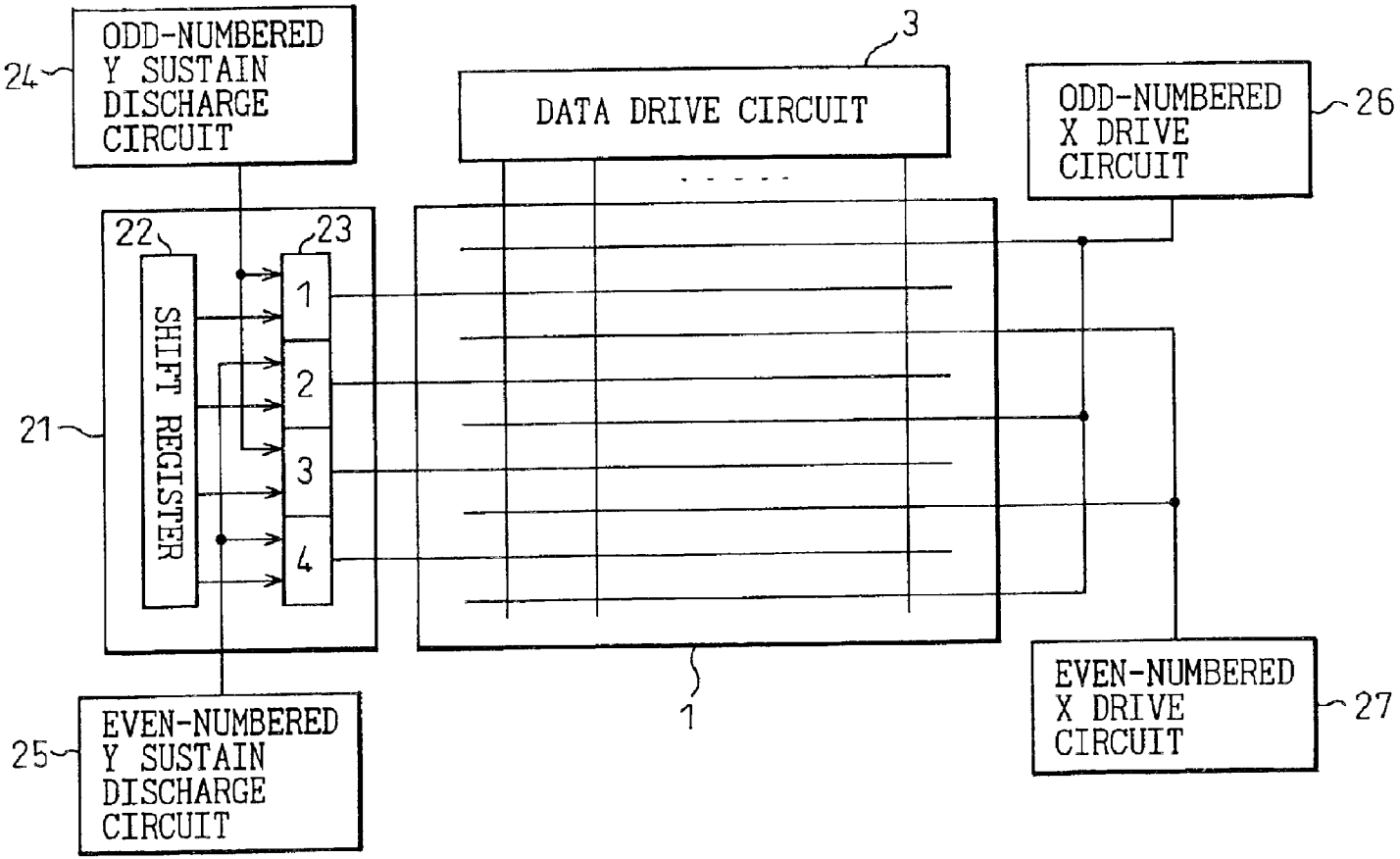
FIG. 11 is a block diagram that shows the rough structure of the PDP apparatus in the third embodiment of the present invention.

FIG. 11 is a diagram that shows the structure of the plasma display (PDP) employing the ALIS method and the drive circuit thereof. As shown schematically, the X electrodes are grouped into the odd-numbered X electrodes and the even-numbered X electrodes and they are designed so as to be driven independently by an odd-numbered X drive circuit 26 and an even-numbered X drive circuit 27, respectively. A Y electrode drive circuit 21 comprises a shift register 22 and a driver 23 and is designed so that the scan pulse generated in the shift register 22 can be sequentially applied to the Y electrode via the driver 23 and at the same time the sustain discharge pulses generated in an odd-numbered Y sustain discharge circuit 24 and an even-numbered Y sustain discharge circuit 25 can be applied to each group of the odd-numbered Y electrodes and the even-numbered Y electrodes, respectively, via the driver 23. In this structure, the display lines are formed between an odd-numbered X electrode and an odd-numbered Y electrode, and between an even-numbered X electrode and an even-numbered Y electrode in the odd-numbered field in the ALIS method, and in the even-numbered field, the display lines are formed between an odd-numbered Y electrode and an even-numbered X electrode and between an even-numbered Y electrode and an odd-numbered X electrode. As the PDP apparatus employing the ALIS method has been described in detail in the above-mentioned publicly known document, a description is omitted here.

The PDP apparatus in the third embodiment of the present invention comprises the same structure as that in the first embodiment shown in FIG. 4 and the difference is that the plasma display panel 1 and the sustain electrode drive circuit 2 employ the ALIS method as shown in FIG. 11. The sustain electrode drive circuit 2 comprises the Y electrode drive circuit 21, the odd-numbered Y sustain discharge circuit 24, the even-numbered Y sustain discharge circuit 25, the odd-numbered x drive circuit 26, and the even-numbered X drive circuit 27. The even-numbered address stop circuit 13 stops the address action to the even-numbered display lines in the odd-numbered field and the even-numbered field.

Figure 12:
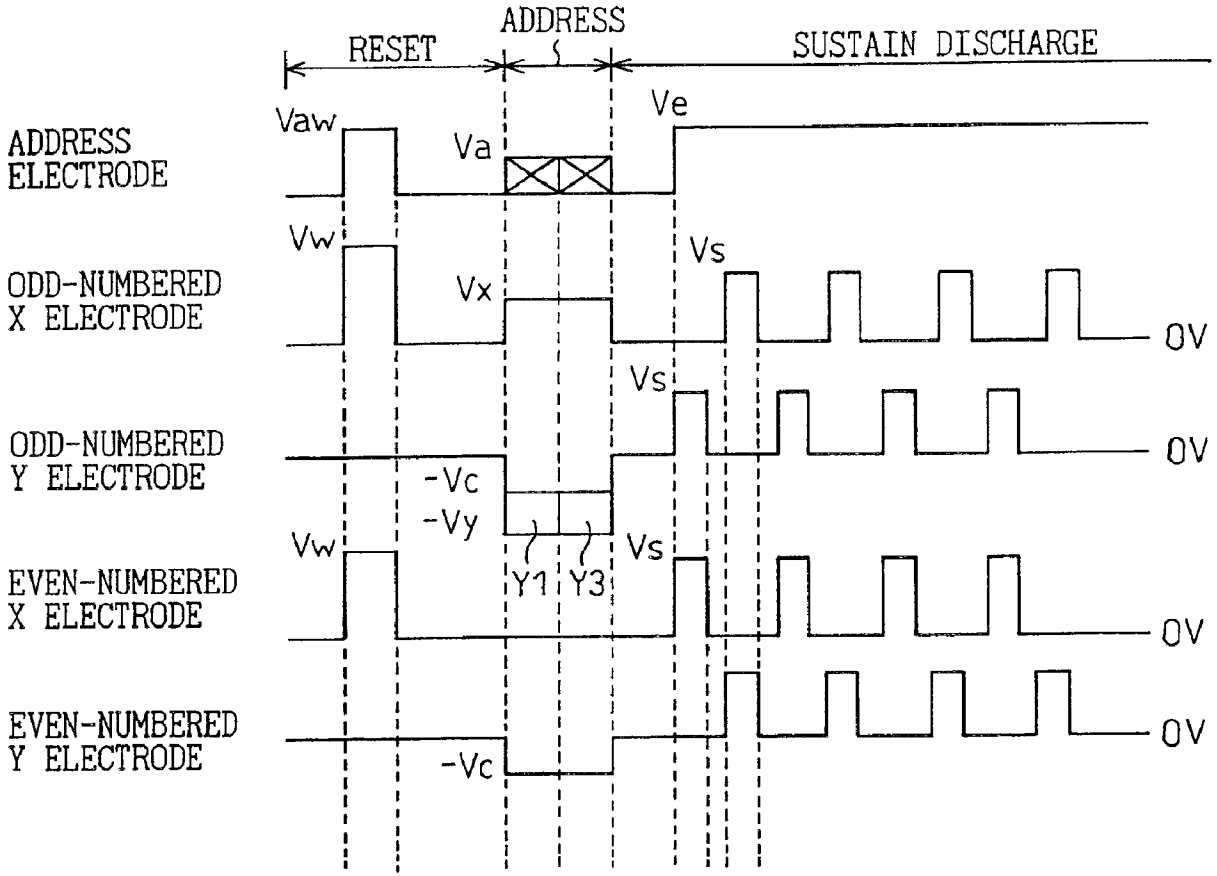
FIG. 12 is a diagram that shows the drive waveforms in the odd-numbered subfield during the thinning process in the third embodiment.
Figure 13:
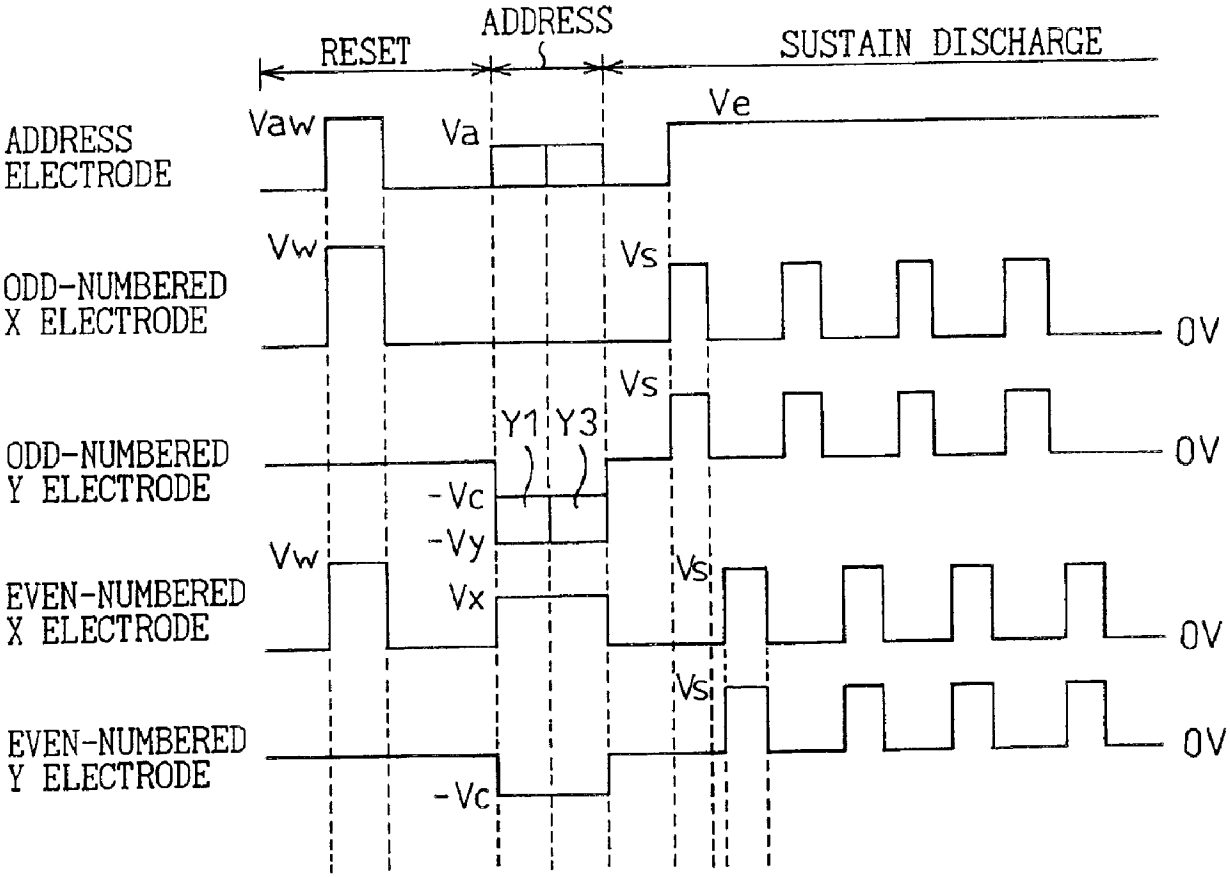
FIG. 13 is a diagram that shows the drive waveforms in the even-numbered subfield during the thinning process in the third embodiment.

The PDP apparatus in the third embodiment performs the thinning process to the specified subfield when the average luminance is below 20% as in the first embodiment. Therefore, when the average luminance is over 20%, the driving method disclosed in the above-mentioned publicly known document is used. In the odd-numbered field, the drive waveforms shown in FIG. 12 are applied to the subfield to which the thinning process is performed. In this way, the address process is performed and the display line is formed between an odd-numbered X electrode and an odd-numbered Y electrode, but the display line is not formed between an even-numbered X electrode and an even-numbered Y electrode because the address process is not performed. This means that every two display lines in the odd-numbered field is thinned out. Then, the saved time is allocated in the similar way as that in the first embodiment in the subfield in which the thinning process has been performed. The drive waveforms shown in FIG. 13 are applied to the subfield to which the thinning process is performed in the even-numbered field. The address process is performed and the display line is formed between an odd-numbered Y electrode and an even-numbered X electrode, but the display line is not formed between an even-numbered Y electrode and an odd-numbered X electrode because the address process is not performed. Therefore, every two display lines are thinned out in the even-numbered field. Then the saved time is allocated, in a similar way as in the first embodiment, in the subfield in which the thinning process has been performed.

Figure 14A:
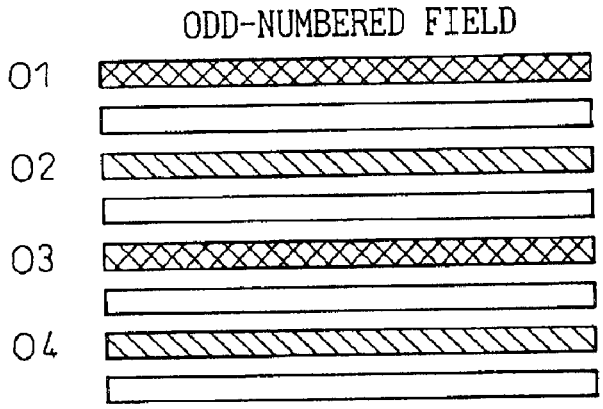
FIG. 14A through FIG. 14C are diagrams that show the display lines in the third embodiment.
Figure 14B:
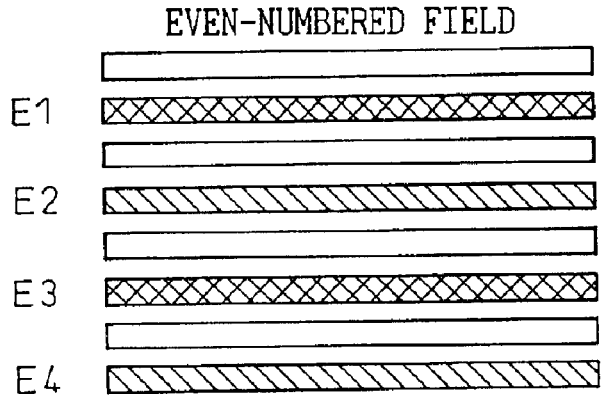
Figure 14C:
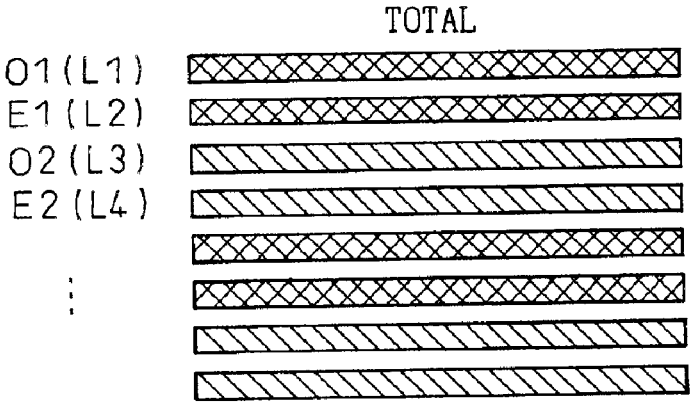

FIG. 14A through FIG. 14C are diagrams that show the display lines in the third embodiment, and FIG. 14A shows the display lines in the odd-numbered field, FIG. 14B shows the display lines in the even-numbered field, and FIG. 14C shows the total display lines, combined, of those in the odd-numbered field and the even-numbered field. As shown in FIG. 14A, odd-numbered display lines O1, O2, . . . , are displayed in the odd-numbered field and light is emitted in every subfield in the display lines O1, O3, . . . , shown by the crossed slant lines, but light is emitted in upper subfields but not in lower subfields in the display lines O2, O4, . . . , shown by the one-directional slant lines. As shown in FIG. 14B, even-numbered display lines E1, E2, . . . , are displayed in the even-numbered field and light is emitted in every subfield in the display lines E1, E3, . . . , shown by the crossed slant lines, but light is emitted in upper subfields, not in lower subfields in the display lines E2, E4, . . . , shown by the one-directional slant lines. As the odd-numbered field and the even-numbered field are repeated alternately, the display lines as shown in FIG. 14C can be obtained if the odd-numbered field and the even-numbered field are combined together. As a result, a pair of two display lines, in one of which light is emitted in every subfield, and in the other of which light is emitted in upper subfields but not in lower subfields, is arranged alternately.

In the third embodiment as described above, in the subfield that is the object of the thinning process, the display data of the third and the fourth display lines, in a set of four display lines, is always lost as shown in FIG. 14C, therefore, the quality of image may be degraded depending on the contents of the image. Therefore in the fourth embodiment, this problem is avoided by varying the positions of the display lines, to which the thinning process is performed, in the odd-numbered field and the even-numbered field.

The PDP apparatus in the fourth embodiment of the present invention has the same structure as that in the second embodiment in FIG. 9 but a difference exists in that the plasma display panel 1 and the sustain electrode drive circuit 2 employ the ALIS method as shown in FIG. 11. The even-numbered address stop circuit 13 stops the address action to the even-numbered display lines in the odd-numbered field and the even-numbered field, and the odd-numbered address stop circuit 15 stops the address action to the odd-numbered display lines in the odd-numbered field and the even-numbered field.

Figure 15:
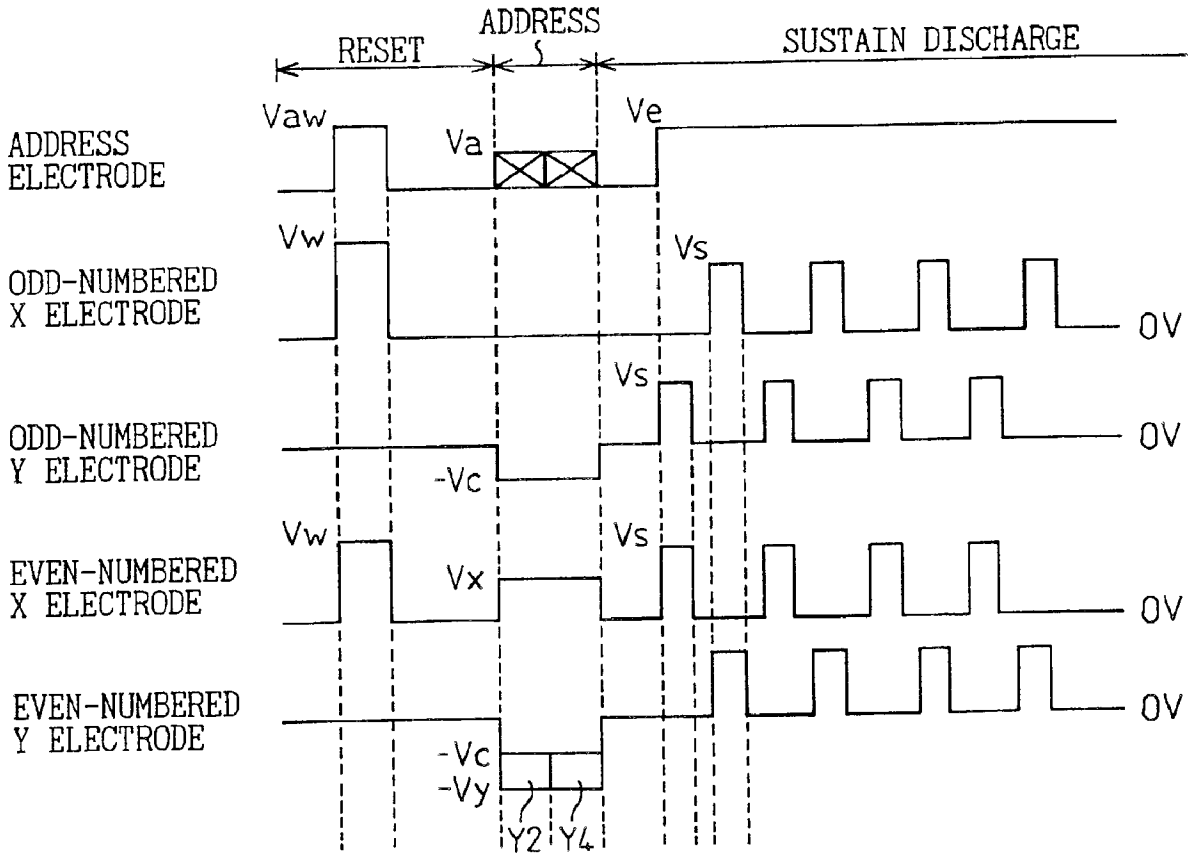
FIG. 15 is a diagram that shows the drive waveforms in the odd-numbered subfield during the thinning process in the fourth embodiment.
Figure 16:
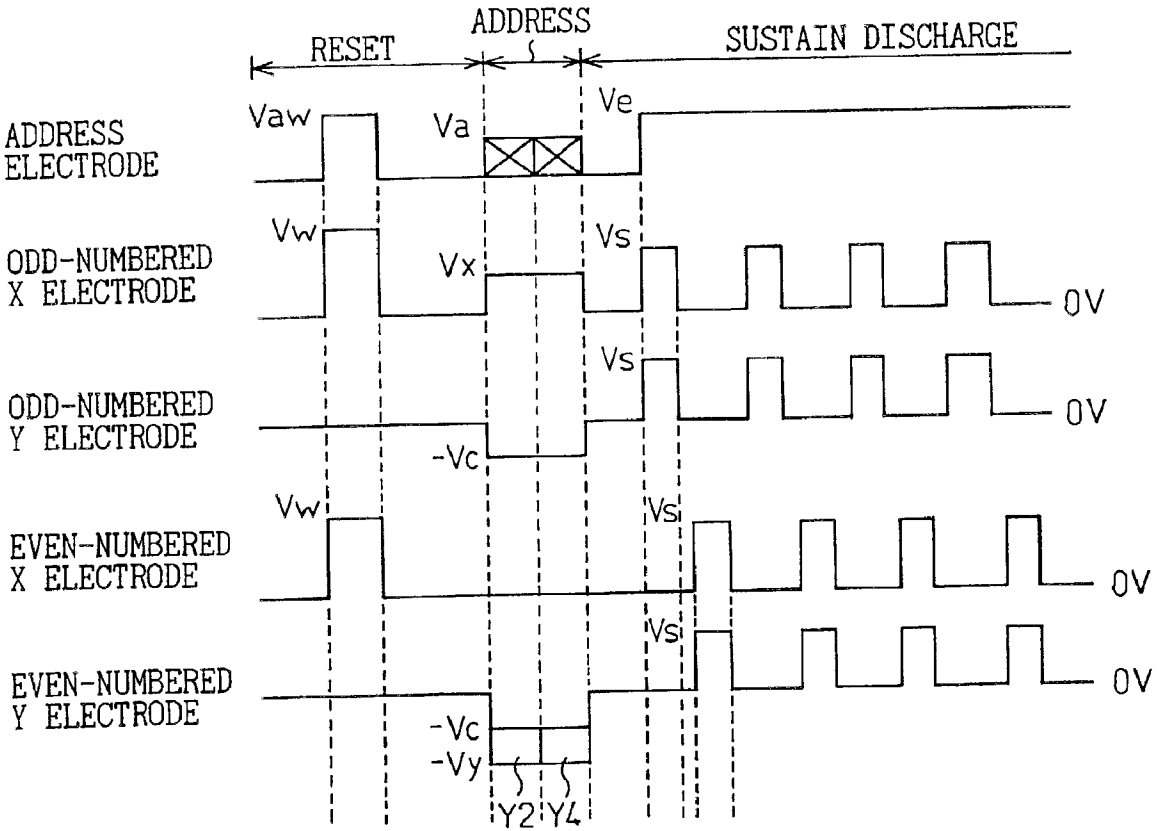
FIG. 16 is a diagram that shows the drive waveforms in the even-numbered subfield during the thinning process in the fourth embodiment.

In the fourth embodiment, when the average luminance is below 20%, for example, either one of the even-numbered address stop circuit 13 and the odd-numbered address stop circuit 15 is put into an active state by the selection circuit 16 according to the vertical synchronization signal V in a certain set of the odd-numbered field and the even-numbered field, and the other of the even-numbered address stop circuit 13 and the odd-numbered address stop circuit 15 is put into an active state in the next set of the odd-numbered field and the even-numbered field. When the thinning process is performed, the odd-numbered address stop circuit 15 is turned off and the even-numbered address stop circuit 13 is turned on in a certain odd-numbered field, and the thinning process is performed in the same way as that in the third embodiment by applying the drive waveforms in FIG. 12 to the subfield that is the object of the thinning process. Also in the next even-numbered field, the odd-numbered address stop circuit 15 is turned off, the even-numbered address stop circuit 13 is turned on, and the thinning process is performed in the same way as that in the third embodiment by applying the drive waveforms in FIG. 13 to the subfield that is the object of the thinning process. In the next odd-numbered field, the odd-numbered address stop circuit 15 is turned on, the even-numbered address stop circuit 13 is turned off, and the thinning process is performed by applying the drive waveforms in FIG. 15 to the subfield that is the object of the thinning process. Also in the next even-numbered field, the odd-numbered address stop circuit 15 is turned on, the even-numbered address stop circuit 13 is turned off, and the thinning process is performed by applying the drive waveforms in FIG. 16 to the subfield that is the object of the thinning process.

Figure 17A:
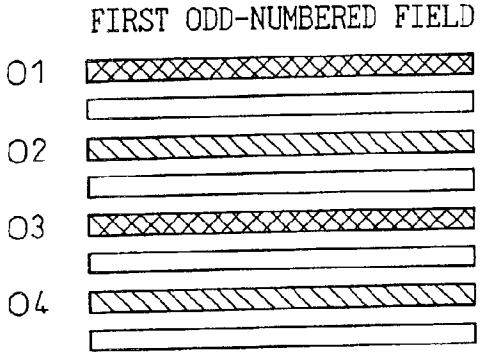
FIG. 17A through FIG. 17D are diagrams that show the display lines in the fourth embodiment.
Figure 17B:
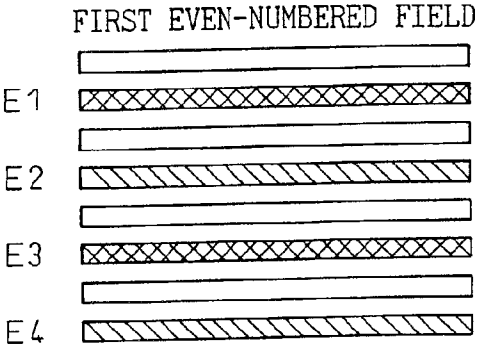
Figure 17C:
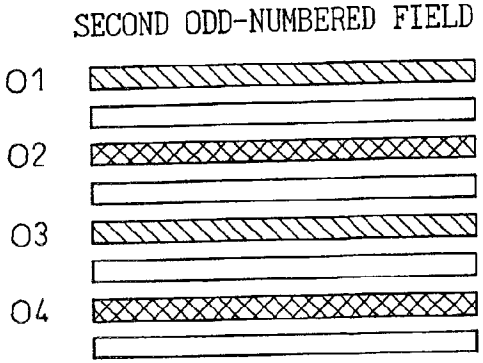
Figure 17D:
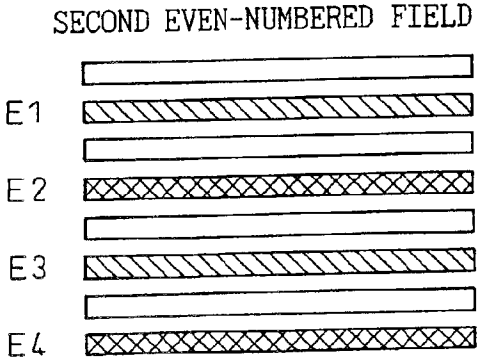

FIG. 17A through FIG. 17D are diagrams that show the display lines in the fourth embodiment, and FIG. 17A shows the display lines in the first odd-numbered field, FIG. 17B shows the display lines in the first even-numbered field, FIG. 17C shows the display lines in the second odd-numbered field that follows, and FIG. 17D shows the display lines in the second even-numbered field, and when the average luminance is below 20%, these four fields are repeated in order. As shown schematically, if the four fields are combined together, a display almost faithful to the original image data can be obtained in total.

Figure 18:
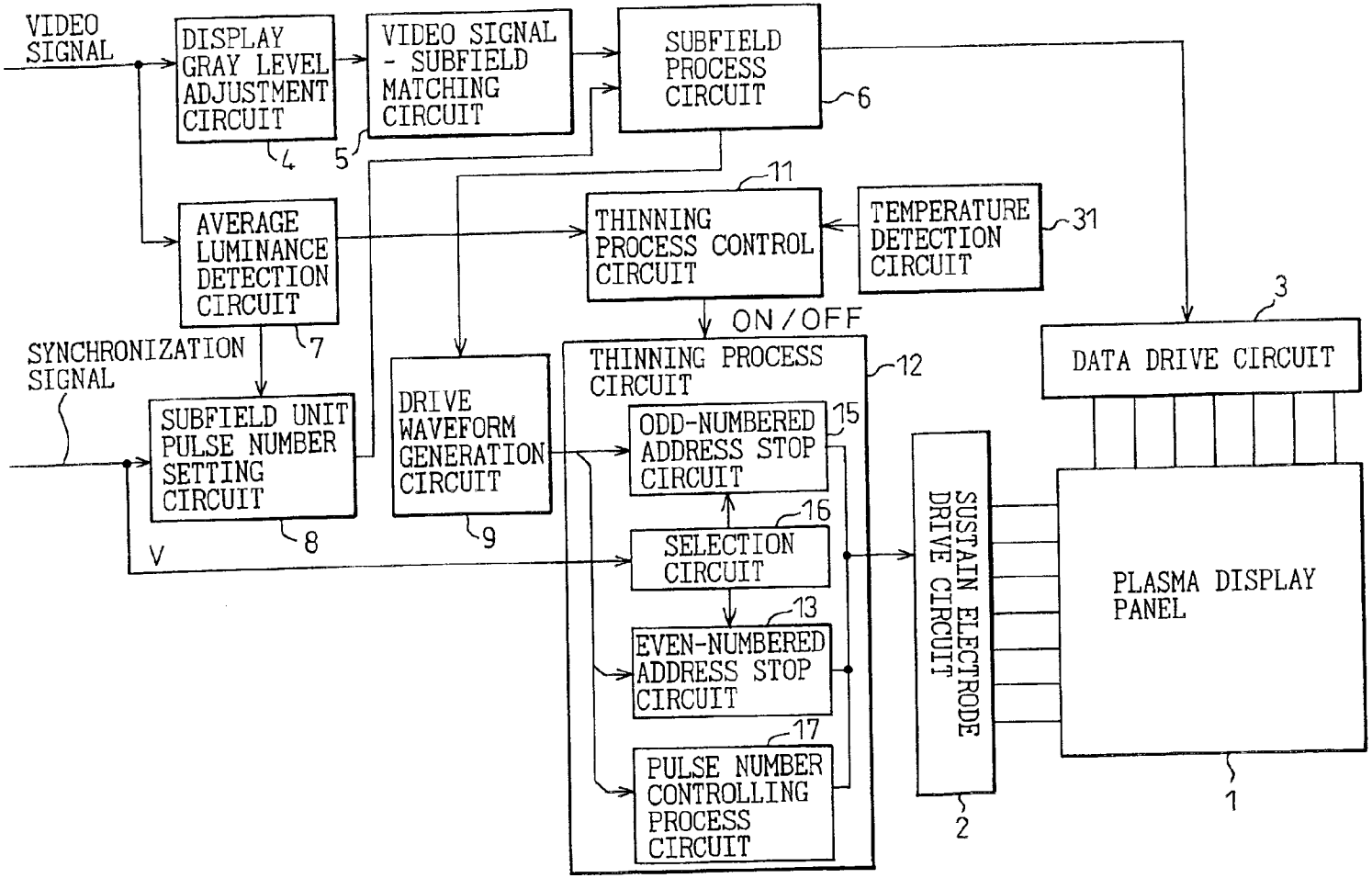
FIG. 18 is a block diagram that shows the rough structure of the PDP apparatus in the fourth embodiment of the present invention.

FIG. 18 is a block diagram that shows the rough structure of the PDP apparatus in the fifth embodiment of the present invention. In the fifth embodiment, the difference is that a temperature detection circuit is added to the structure in the second and the fourth embodiments shown in FIG. 9. When access to the display lines is not performed in part of subfields as in the first through the fourth embodiments, and the luminance is improved by increasing the length of the sustain discharge period with the saved time thereby, the panel surface may be damaged because the temperature increases locally in the plasma display panel 1. In order to avoid the problem, in the fifth embodiment, a temperature detection circuit 31 monitors the surface temperature of the panel and if it is detected that the temperature of the panel surface has exceeded a specified value, a detection signal is sent to the thinning process control circuit 11. The thinning process control circuit 11 turns off the thinning process circuit 12 on receiving the detection signal even if the average luminance is below 20%.

According to the present invention, the peak luminance of the plasma display panel can be improved almost without modifying the existing circuit structure. Moreover, the damage of the panel due to the increase of the temperature caused by the luminance improvement can be avoided.

We claim:

1. A plasma display apparatus configured to perform a gray level display using a subfield method, each subfield of a display field comprising at least an address period in which a cell to be lit is selected and a sustain discharge period in which the selected cell is lit, said apparatus comprising:

a display line number change circuit that changes a number of lines to be displayed in some of subfields; and a luminance compensation circuit that increases the sustain discharge period in the subfields in which the number of lines to be displayed has been changed, so as to compensate a luminance decrease due to the change of display line number.

2. The plasma display apparatus as set forth in claim 1, further comprising;

an average luminance detection circuit that detects the average luminance of an input image signal; and a display line number control circuit that controls whether or not to activate the display line number change circuit and the luminance compensation circuit based on the average luminance.

3. The plasma display apparatus as set forth in claim 1, further comprising;

a sustain discharge period change circuit that increases the sustain discharge periods of each subfield by allocating the remaining time, which is the time saved by changing the number of lines to be displayed by the display line number change circuit minus that used by the luminance compensation circuit, according to a ratio of lengths of the sustain discharge periods.

4. The plasma display apparatus as set forth in claim 1, wherein some of subfields, in which the number of lines to be displayed has been changed, include a subfield that has a comparably shorter sustain discharge period in all of the subfields.

5. The plasma display apparatus as set forth in claim 1, wherein the display line number change circuit displays one of plural adjacent display lines and does not display the other display lines.

6. The plasma display apparatus as set forth in claim 5, wherein the display line number change circuit successively changes the display line to be displayed among the plural adjacent display lines.

7. The plasma display apparatus as set forth in claim 1, wherein the apparatus performs an interlaced display in which odd-numbered fields, which display display lines in odd-numbered rows, and even-numbered fields, which display the display lines in even-numbered rows, are repeated alternately, wherein the display line number change circuit displays one of plural adjacent display lines and does not display the other display lines in the odd-numbered field and the even-numbered field, respectively.

8. The plasma display apparatus as set forth in claim 7, wherein the display line number change circuit successively changes the display line to be alternately displayed among the plural adjacent display lines.

9. The plasma display apparatus as set forth in claim 1, further comprising:

a temperature detection circuit that detects a temperature of a plasma display panel, wherein the display line number change circuit does not change the number of lines to be alternately displayed when the temperature of the plasma display panel is over a reference value.

10. The plasma display apparatus as set forth in claim 1, wherein the display line number change circuit changes the number of lines to be displayed in some of the subfields so that one display line in adjacent n display lines is displayed and the remaining n-1 display lines are not displayed, and the luminance compensation circuit increases the sustain discharge period in the subfields, in which the number of lines to be displayed has been changed, by multiplying n.

11. The plasma display apparatus as set forth in claim 1, wherein the luminance compensation circuit increases the sustain discharge period in the subfields, in which the number of lines to be displayed has been changed, by multiplying a reverse ratio of the lines to be displayed with respect to all display lines.

12. A method of driving a plasma display apparatus configured to perform a gray level display using a subfield method, each subfield of a display field comprising at least an address period in which a cell to be lit is selected and a sustain discharge period in which the selected cell is lit, the method comprising:

changing a number of lines to be displayed in some of subfields; and increasing the sustain discharge period in the subfields in which the number of lines to be displayed has been changed, so as to compensate a luminance decrease due to the change of display line number.

13. The method of driving a plasma display apparatus as set forth in claim 12, further comprising:

detecting the average luminance of an input image signal; and determining whether or not to change the number of lines to be displayed based on the detected average luminance.

14. The method of driving a plasma display apparatus as set forth in claim 12, further comprising:

increasing the sustain discharge periods of each subfield is increased by allocating the remaining time, which is the time saved by changing the number of lines to be displayed in some of subfields minus that used to increase the sustain discharge period in the subfield, according to a ratio of lengths of the sustain discharge periods.

15. The method of driving a plasma display apparatus as set forth in claim 12, wherein some subfields in which the number of lines to be displayed is changed are subfields that have comparably shorter sustain discharge period than the remaining subfields.

16. The method of driving a plasma display apparatus as set forth in claim 12, wherein when the number of lines to be displayed in the subfields having the odd-numbered electrodes with the average luminance below the predetermined value is changed, one of plural adjacent display lines is displayed and the other display lines are not displayed.

17. The method of driving a plasma display apparatus as set forth in claim 16, further comprising:

successively changing the display line to be alternately displayed among the plural adjacent display lines.

18. The method of driving a plasma display apparatus as set forth in claim 12, further comprising:

performing an interlaced display in which an odd-numbered field, which displays the display lines in odd-numbered rows, and an even-numbered field, which displays the display lines in even-numbered rows, are repeated alternately, wherein one of plural adjacent display lines is displayed and the other display lines are not displayed in the odd-numbered field and the even-numbered field, respectively.

19. The method of driving a plasma display apparatus as set forth in claim 18, further comprising:

successively changing the display line to be alternately displayed among the plural adjacent display lines.

20. The method of driving a plasma display apparatus as set forth in claim 12, further comprising:

detecting the temperature of a plasma display panel, wherein the number of lines to be displayed is not changed when the temperature of the plasma display panel is over a reference value.

21. A plasma display apparatus configured to perform a gray level display, each subfield of a display field comprising at least an address period in which a cell to be lit is selected and a sustain discharge period in which the selected cell is lit, the apparatus comprising:

an average luminance detection circuit detecting an average luminance of a subfield that is below a predetermined value and outputting a detection signal indicative thereof;

an odd-numbered address stop circuit successively applying, in response to the detection signal, scan pulses during the address period only to odd-numbered electrodes of the subfield having the average luminance below the predetermined value, wherein a time duration of the address period of the subfield is half the time duration of the address periods to other subfields; and a pulse number controlling process circuit allocating a remaining half of the time duration of the address period to the sustain discharge periods corresponding to each subfield.

22. The plasma display apparatus as set forth in claim 21, wherein the pulse number controlling process circuit allocates a portion of the remaining half of the time duration to the sustain discharge period corresponding to the subfield having the average luminance below the predetermined value, by doubling a number of sustain discharge pulses in the sustain discharge period.

23. The plasma display apparatus as set forth in claim 22, wherein the pulse number controlling process circuit allocates another portion of the remaining half of the time duration to the sustain discharge periods corresponding to the other subfields, according to a luminance ratio weight of each subfield.

24. The plasma display apparatus as set forth in claim 21, further comprising:

a thinning process control circuit receiving the detection signal and specifying the subfield where the average luminance is below the predetermined value.

25. A plasma display apparatus configured to perform a gray level display, each subfield of a display field comprising at least an address period in which a cell to be lit is selected and a sustain discharge period in which the selected cell is lit, the apparatus comprising:

an average luminance detection circuit detecting an average luminance of a subfield that is below a predetermined value and outputting a detection signal indicative thereof;

an odd-numbered address stop circuit successively applying, in response to the detection signal and in a first field, scan pulses during the address period only to odd-numbered electrodes of the subfield having the average luminance below the predetermined value;

an even-numbered address stop circuit successively applying, in response to the detection signal and in a second field, scan pulses during the address period only to even-numbered electrodes of the subfield having the average luminance below the predetermined value, wherein the first field and second field are repeated alternately and, for each field, a time duration of the address period of the subfield having the average luminance below the predetermined value is half the time duration of the address periods corresponding to other subfields; and a pulse number controlling process circuit allocating a remaining half of the time duration of the address period to the sustain discharge periods corresponding to each subfield.

* * * * *